US005809945A

United States Patent [19]

Creeron et al.

[11] Patent Number: 5,809,945

[45] Date of Patent: Sep. 22, 1998

[54] DRAIN-AND-FILL METHODS AND APPARATUS FOR AUTOMOTIVE COOLING SYSTEMS

[75] Inventors: Richard F. Creeron, Valley Stream, N.Y.; Norman D. Berke, New Milford, Conn.; Jerry Motard, Newburgh, N.Y.

[73] Assignee: Prestone Products Corporation, Danbury, Conn.

[21] Appl. No.: 513,429

[22] Filed: Aug. 10, 1995

[51] Int. Cl.[6] ..... F02B 77/00

[52] U.S. Cl. ..... 123/41.14; 134/169 A

[58] Field of Search ..... 123/41.01, 198 DA, 123/198 E, 41.51, 41.14; 134/169 A

[56] References Cited

U.S. PATENT DOCUMENTS

| | | | |
|---|---|---|---|
| 2,029,232 | 1/1936 | Green | 137/625.29 |
| 4,293,031 | 10/1981 | Babish et al. | 137/599.1 |
| 4,378,034 | 3/1983 | Albertson | 134/22.1 |
| 4,553,587 | 11/1985 | Traylor | 165/95 |
| 4,791,890 | 12/1988 | Miles et al. | 123/41.14 |
| 4,793,403 | 12/1988 | Vataru et al. | 123/41.14 |
| 4,840,223 | 6/1989 | Lee | 165/95 |
| 4,901,786 | 2/1990 | Vataru et al. | 165/1 |
| 4,911,211 | 3/1990 | Andersen | 134/169 A |
| 4,946,595 | 8/1990 | Miller, Jr. | 210/651 |
| 4,949,765 | 8/1990 | Creeron | 134/169 A |
| 4,996,874 | 3/1991 | Colomer et al. | 73/118.1 |
| 5,078,866 | 1/1992 | Filowitz | 210/167 |
| 5,094,757 | 3/1992 | Light | 210/712 |
| 5,097,894 | 3/1992 | Cassia | 123/41.14 |
| 5,232,513 | 8/1993 | Suratt et al. | 134/21 |
| 5,390,636 | 2/1995 | Baylor et al. | 134/159 A |
| 5,511,590 | 4/1996 | Turcotte et al. | 134/169 A |

FOREIGN PATENT DOCUMENTS

| | | |
|---|---|---|
| 538 214 A1 | 4/1993 | European Pat. Off. . |
| WO 84/04734 | 12/1984 | WIPO . |

*Primary Examiner*—David A. Okonsky
*Attorney, Agent, or Firm*—Cummings & Lockwood

[57] ABSTRACT

A drain-and-fill machine is disclosed that can accommodate a cooling system having an inlet-side thermostat. The drain-and-fill machine includes a reservoir of fresh or recycled antifreeze/coolant and a reservoir to receive used antifreeze/coolant. The drain-and-fill machine introduces the fresh or recycled antifreeze/coolant into the cooling system of an automobile while simultaneously draining the used antifreeze/coolant into the used coolant reservoir. When the engine is cold, the engine's inlet side-thermostat will prevent new antifreeze/coolant from entering the cooling system, thereby making it possible to drain the used antifreeze/coolant from the cooling system, without simultaneously replenishing the cooling system with fresh or recycled antifreeze/coolant. The present drain-and-fill machine includes a thermostat disposed in the reservoir drain line having similar operating characteristics to the engine's inlet-side thermostat. The drain line thermostat will thus prevent the used antifreeze/coolant from being drained from the engine's cooling system when the engine's inlet-side thermostat is closed, until the coolant has reached a sufficient temperature to allow both the inlet-side and drain-line thermostats to open.

9 Claims, 2 Drawing Sheets

DRAIN-AND-FILL METHODS AND APPARATUS FOR AUTOMOTIVE COOLING SYSTEMS

FIELD OF THE INVENTION

The present invention pertains to improved drain-and-fill methods and apparatus for introducing fresh or recycled antifreeze/coolant into an automobile cooling system while simultaneously draining the used fluid, and, more particularly, to a drain-and-fill machine designed for an automotive engine cooling system having an inlet-side thermostat.

BACKGROUND OF THE INVENTION

In order to prevent over-heating, freeze-up or corrosion of an automobile engine and to maintain the efficient operation of the automobile's cooling system, the antifreeze/coolant contained in the cooling system should be substantially free of contaminants. Over time, however, the antifreeze/coolant will degrade and become contaminated, for example, by dirt, rust, metal, and wood, and thereby inhibit the efficient operation of the cooling system. Thus, the original equipment manufacturers (OEMs) recommend that antifreeze/coolant be periodically replaced with fresh or recycled antifreeze/coolant.

In order to automate the process of replacing used antifreeze/coolant with fresh or recycled antifreeze/coolant, "drain-and-fill" machines have been introduced at automotive service stations. For a detailed discussion of one such drain-and-fill machine, see U.S. Pat. No. 5,571,420, issued Nov. 5, 1996, assigned to the assignee of the present invention and incorporated by reference herein. Generally, such drain-and-fill machines will include a source of fresh or recycled antifreeze/coolant and a reservoir tank for storing the used antifreeze/coolant which is removed from the automotive cooling system. The upper radiator hose of the automobile cooling system is typically severed, and one section of the severed hose is connected to the source of fresh or recycled antifreeze/coolant by means of a fill hose, while the second section of the severed hose is connected to the storage tank by means of a drain hose. The used antifreeze/coolant is then displaced by operation of the fresh or recycled antifreeze/coolant entering the cooling system through the fill hose, either under the force of gravity or by action of an external pump.

Recently, however, the automobile industry has introduced cooling systems featuring thermostats between the radiator and the engine portion of the system, often referred to as inlet-side thermostats. Unfortunately, cooling systems with inlet-side thermostats are often incompatible with conventional drain-and-fill machinery, which are designed to introduce fresh or recycled antifreeze/coolant into cooling systems featuring outlet-side thermostats. It has been discovered that when the engine is cold, the engine's inlet-side thermostat will be closed and will thus prevent the new antifreeze/coolant from being drawn into the cooling system. The used antifreeze/coolant, however, will nonetheless be drained from the automobile through the drain hose by operation of the cooling system water pump. Thus, the cooling system is essentially drained of any antifreeze/coolant as the inlet-side thermostat blocks the flow of fresh or recycled antifreeze/coolant from entering the system, while the engine's water pump forces the used antifreeze/coolant out through the drain line. When the cooling system is drained of antifreeze/coolant, the engine is likely to over-heat and encounter permanent damage.

Accordingly, a need exists for an improved drain-and-fill machine capable of exchanging the antifreeze/coolant of an engine cooling system having an inlet-side thermostat. A further need exists for a drain-and-fill machine that will prevent the draining of old or used antifreeze/coolant from an engine cooling system without the simultaneous introduction of new, fresh or recycled antifreeze/coolant into the cooling system.

SUMMARY OF THE INVENTION

Generally, according to one aspect of the invention, a drain-and-fill machine, suitable for use with cooling systems having inlet-side thermostats, is disclosed. The drain-and-fill machine includes a first reservoir for storing a supply of fresh or recycled antifreeze/coolant and a second reservoir for storing the used or spent antifreeze/coolant which is drained from the cooling system. In order to interconnect with the cooling system of an automobile, the drain-and-fill machine preferably includes an inlet line and a drain line. The drain-and-fill machine introduces the fresh or recycled antifreeze/coolant into the cooling system of an automobile while simultaneously draining the used antifreeze/coolant into the used coolant reservoir.

When the automobile's engine is cold, the inlet side-thermostat will prevent new antifreeze/coolant from entering the cooling system, thereby making it possible to drain the used antifreeze/coolant from the cooling system, without simultaneously replenishing the cooling system with fresh or recycled antifreeze/coolant. Thus, according to a feature of the present invention, the drain-and-fill machine includes a thermostat disposed in the reservoir drain line which has similar operating characteristics to the engine's inlet-side thermostat. The drain line thermostat will thus prevent the used antifreeze/coolant from being drained from the engine's cooling system when the engine's inlet-side thermostat is closed, until the coolant has reached a sufficient temperature to allow both the inlet-side and drain-line thermostats to open.

From the process point of view, the invention includes a method for exchanging used antifreeze/coolant with fresh or recycled antifreeze/coolant in an automotive cooling system having an inlet-side thermostat. The method comprising the steps of: supplying fresh or recycled antifreeze/coolant to an inlet side of said automotive cooling system; draining used antifreeze/coolant from an outlet side of said cooling system substantially simultaneously with said supplying step; and preventing the draining step when said inlet-side thermostat is closed.

A more complete understanding of the present invention, as well as further features and advantages of the invention, will be obtained by reference to the following Detailed Description with the accompanying drawings.

For the sake of brevity and clarity, like components and elements will bear the same designation and numbering throughout the figures

DETAILED DESCRIPTION

Figure 1:
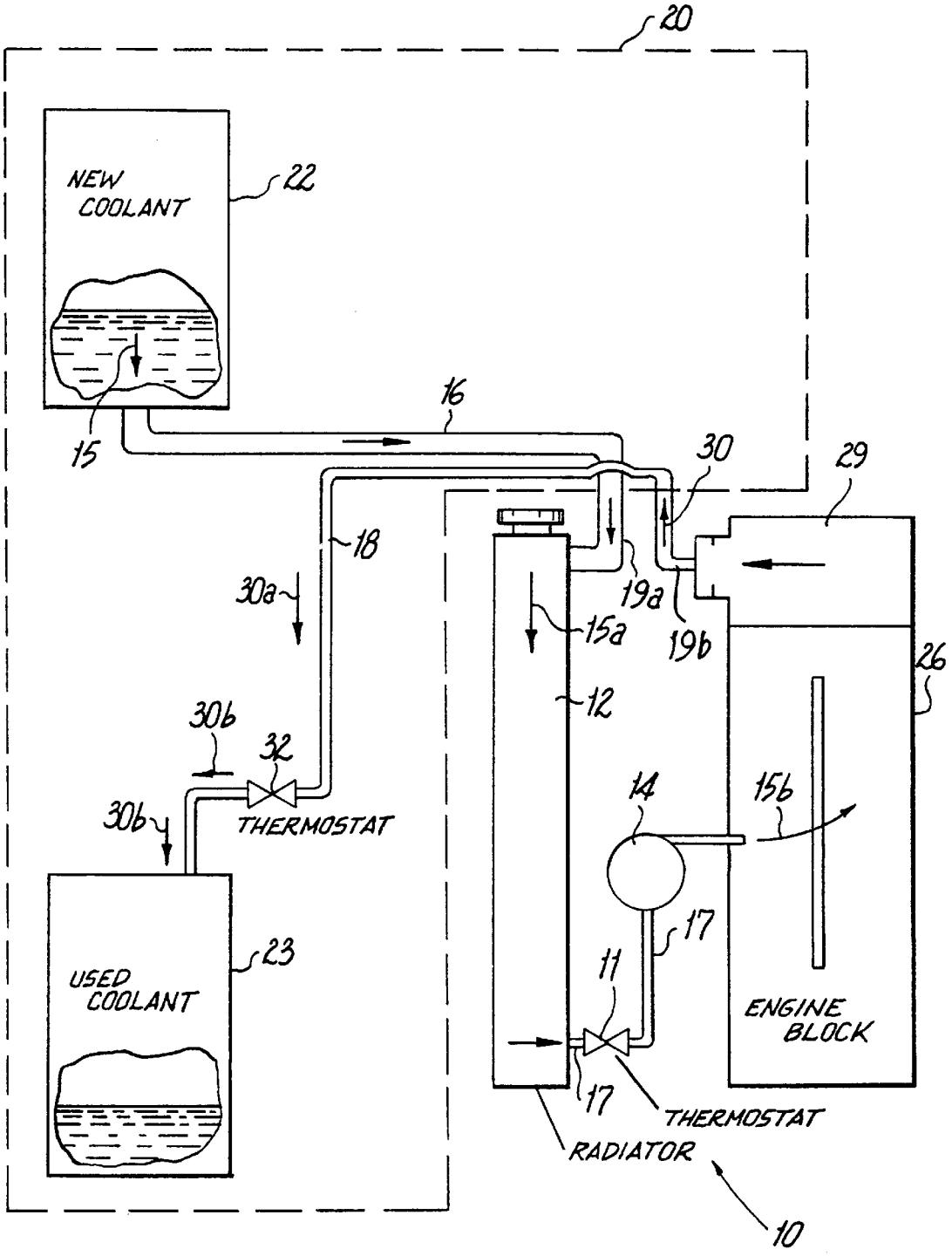
FIG. 1 is a schematic diagram illustrating a drain-and-fill machine according to the present invention, as used with a conventional flow cooling system having an inlet-side thermostat.

A drain-and-fill machine 20 for changing the antifreeze/coolant in a cooling system 10 of an automobile is shown in FIG. 1. As discussed further below, the drain-and-fill machine 20 can accommodate a cooling system having an inlet-side thermostat. According to one feature of the present invention, the drain-and-fill machine 20 ensures that used antifreeze/coolant will not be drained from the cooling system 10 unless the new or recycled antifreeze/coolant is being simultaneously introduced into the cooling system 10 through the inlet-side thermostat.

As shown in FIG. 1, the drain-and-fill machine 20 includes a first reservoir 22 for storing a supply of fresh or recycled antifreeze/coolant and a second reservoir 23 for storing the used or spent antifreeze/coolant which is drained from the cooling system 10. In addition, the drain-and-fill machine 20 includes an inlet line 16 and a drain line 18 for interconnecting with the automotive cooling system 10, in a manner described below.

The automotive cooling system 10 includes an engine 26 and a radiator 12 which are connected by an upper radiator hose 19 and a lower radiator hose 17. As shown in FIG. 1, in order to connect with the drain-and-fill machine 20, the upper radiator hose 19 has been severed into two portions, to provide an upper radiator hose section 19*a* and an upper radiator hose section 19*b*. The upper radiator hose section 19*a*, which is in communication with the radiator 12, is preferably attached to the fresh or recycled antifreeze/coolant reservoir 22 for introducing fresh or recycled antifreeze/coolant into the radiator 12 via inlet line 16. Likewise, the upper radiator hose section 19*b*, which is in communication with the engine 26, is preferably attached to the drain line 18 that leads to the used antifreeze/coolant reservoir 23.

In addition, the cooling system 10 includes a water pump 14 which causes the liquid in the cooling system to circulate in a downward-flow direction through the radiator 12 and through the engine 26 when the automobile is running, as indicated by the directional arrows 15*a* and 15*b* in FIG. 1. Engine 26 may also be in communication with a heater (not shown) of the cooling system 10 by means of heater hoses, as would be apparent to a person of ordinary skill in the art.

As shown in FIG. 1, the cooling system 10 includes a thermostat 11 which is preset to open when the liquid in the cooling system 10 has reached a predefined temperature. Unlike conventional cooling systems, however, where the thermostat is generally positioned on the outlet-side of the engine 26 before the radiator 12, the thermostat 11 of the cooling system 10 shown in FIG. 1 is located on the inlet-side of the cooling system, between the radiator 12 and the water pump 14, as shown.

As indicated above, however, when the engine 26 is cold, the engine's inlet-side thermostat 11 will be closed and will thus prevent the new antifreeze/coolant from being drawn into the cooling system 10. Thus, using a conventional drain-and-fill machine, the cooling system 10 would tend to be drained of antifreeze/coolant as the inlet-side thermostat 11 blocks the flow of new antifreeze/coolant from entering into the cooling system 10, while the engine's water pump 14 forces the used antifreeze/coolant out through the drain line 18.

Thus, according to one feature of the present invention, a thermostat 31 is disposed in the reservoir drain line 18. In this manner, when the engine is cold, the thermostat 31 will be in the closed position, and the cold antifreeze/coolant will not be drained from the engine's cooling system 10 into the drain reservoir 23 until the operating temperature of the engine rises and the inlet-side thermostat 11 is opened to allow the fresh or recycled antifreeze/coolant to be simultaneously pumped into the cooling system 10. The thermostat 31 should have substantially similar operating characteristics as the automobile's inlet-side thermostat 11, to ensure that the drain line thermostat 31 will open at approximately the same operating temperature as the inlet-side thermostat 11. For example, the thermostats of many automobiles are designed to open when the circulating antifreeze/coolant has reached an operating temperature of between 180° F. and 200° F.

During operation, the fresh or recycled antifreeze/coolant enters the radiator 12 via fill line 16 and upper radiator hose section 19*a* and then flows in a downward direction to the bottom of the radiator 12 and out the bottom through lower radiator hose 17, as indicated by directional arrows 15*a*. Thereafter, the fresh or recycled antifreeze/coolant comes into contact with the inlet-side thermostat 11. When the antifreeze/coolant has reached its normal operating temperature, the thermostat 11 will be open. The open thermostat 11 will allow the fresh or recycled antifreeze/coolant to be pumped into the engine block 26 via the water pump 14, as indicated by directional arrow 15*b*, while the used antifreeze/coolant will be displaced by the fresh or recycled antifreeze/coolant and drained from the upper radiator hose section 19*b* connected to cylinder head 29. Thereafter, the used antifreeze/coolant will be transferred via drain line 18 to the used antifreeze/coolant reservoir 23, as indicated by directional arrows 30, 30*a* and 30*b*.

If, however, the antifreeze/coolant in the system has not reached the engine's normal operating temperature, the placement of thermostat 31 in the drain line 18 will prevent the draining of used antifreeze/coolant from the cylinder head 29. Thus, used antifreeze/coolant will not be drained from the cooling system unless it is simultaneously being replenished with new antifreeze/coolant from reservoir 22.

In a further embodiment of the present invention, an external pump (not shown) may be disposed in inlet line 16 to facilitate the transfer of antifreeze/coolant from the fresh or recycled antifreeze/coolant reservoir 22 to the radiator 12. Preferably, the external pump is embodied as a positive displacement or diaphragm pump. Alternatively, the fresh or recycled antifreeze/coolant reservoir 22 may be positioned at a height above the upper radiator hose 19, such that gravity provides a sufficient force to displace the used antifreeze/coolant from the cooling system 10.

In yet another embodiment of the present invention, the external pump (not shown) disposed in the inlet line 16, provides sufficient pressure to the antifreeze/coolant entering the cooling system 10 to force open all of the valves and thermostats in the cooling system 10, regardless of the current operating temperature of the antifreeze/coolant. Effectively, the high pressure flow is utilized to overcome the operating specifications of the cooling system thermostat. It has been found that a pressure of approximately 17 to 22 psi will force open the thermostats of most automobiles, without damaging any valves, hoses, clamps or other components of the cooling system. In this manner, the drain-and-fill machine 20 can operate to exchange the antifreeze/coolant regardless of the operating temperature of the automobile, even if the automobile is not running. In addition, it is noted that in such an embodiment, the drain line thermostat 31 is not required, as the inlet side thermostat 11 will no longer prevent the circulation of the new antifreeze/coolant.

It is noted that a cooling system, such as the cooling system 10 shown in FIG. 1, is a closed high pressure system.

Thus, in order to relieve the pressure before severing the upper radiator hose 19, a well known venturi-type aspirator (not shown) can be connected to the overflow hose of the radiator 12. In this manner, the venturi aspirator provides a vacuum to assist in the depressurization of the cooling system 10. Alternatively, the upper radiator hose can be depressurized by a pressure relief device, such as the one described in U.S. Pat. No. 5,099,804, assigned to the assignee of the present invention and incorporated by reference herein.

Figure 2:
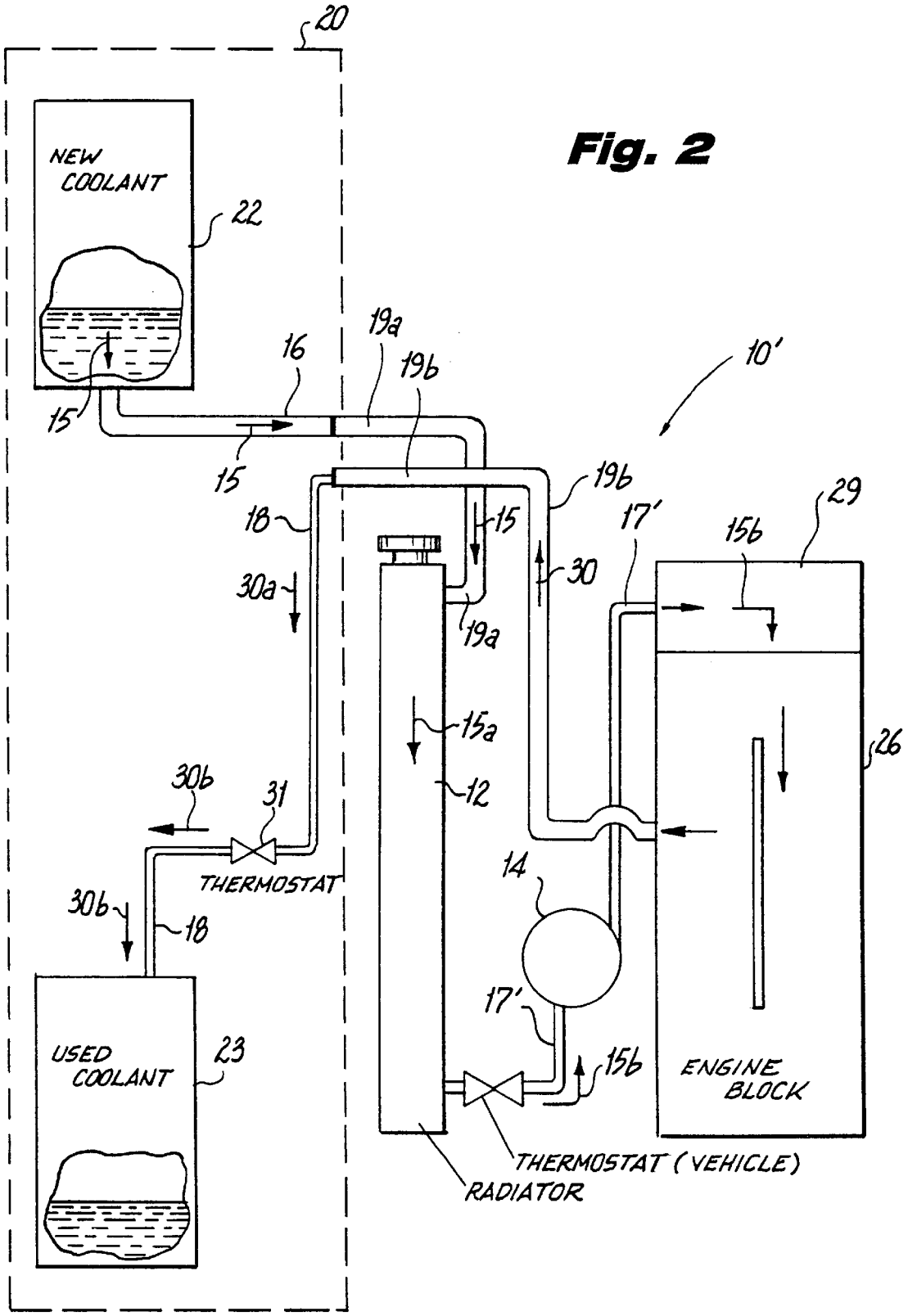
FIG. 2 is a schematic diagram illustrating the drain-and-fill machine according to the present invention, as used with a reverse-flow cooling system having an inlet-side thermostat.

As indicated above, inlet-side thermostats are frequently associated with reverse-flow engine cooling systems 10', such as the one illustrated in FIG. 2. The drain-and-fill machine 20 operates in the same manner as described for FIG. 1, interconnecting with the cooling system 10' by means of the severed upper radiator hose sections 19*a* and 19*b*. The circulation flow within the reverse-flow engine cooling system 10', however, is different than the flow illustrated in FIG. 1. In a reverse-flow cooling system 10', the lower radiator hose 17' is connected to the cylinder head 29. Thus, the water pump 14 of the cooling system 10' pumps the fresh or recycled antifreeze/coolant to the cylinder head 29, as indicated by the directional arrows 15*b* in FIG. 2. The used antifreeze/coolant is drained from the engine block 26 via upper radiator hose section 19*b* and drain line 18. The thermostat 31 in drain line 18 also functions in a like manner as described above for the cooling system 10 in conjunction with FIG. 1.

It is to be understood that the embodiments and variations shown and described herein are illustrative of the principles of this invention only and that various modifications may be implemented by those skilled in the art without departing from the scope and spirit of the invention.

We claim:

1. A drain-and-fill apparatus for use in exchanging fresh or recycled antifreeze/coolant for used antifreeze/coolant in the cooling system of an automotive engine having an inlet-side thermostat, said apparatus comprising;

a first reservoir for storing fresh or recycled antifreeze/coolant;

a second reservoir for receiving used antifreeze/coolant;

an inlet line operatively connectable between said first reservoir and an inlet of said automotive cooling system;

an outlet line operatively connectable between an outlet of said automotive cooling system and said second reservoir; and a thermostat disposed in said outlet line between said second reservoir and said outline line of said automotive cooling system, said thermostat disposed in said outlet line preventing the flow of said used antifreeze/coolant if said used antifreeze/coolant has not reached a predefined temperature.

2. The drain-and-fill apparatus according to claim 1, further comprising a pump disposed in said inlet line to assist the transfer of said fresh or recycled antifreeze/coolant from said first reservoir to said cooling system.

3. The drain-and-fill apparatus according to claim 1, further comprising a pump disposed in said inlet line to circulate said fresh or recycled antifreeze/coolant through said cooling system with a sufficient force to open said inlet-side thermostat.

4. The drain-and-fill apparatus according to claim 1, further comprising a venturi aspirator connected to an overflow hose of a radiator in said cooling system for depressurizing said cooling system.

5. A method for exchanging used antifreeze/coolant with fresh or recycled antifreeze/coolant in an automotive cooling system having an inlet-side thermostat, said method comprising the steps of:

supplying fresh or recycled antifreeze/coolant to an inlet side of said automotive cooling system;

draining used antifreeze/coolant from an outlet side of said cooling system substantially simultaneously with said supplying step; and preventing the draining step when said inlet-side thermostat is closed.

6. The method according to claim 5, wherein the step of supplying fresh or recycled antifreeze/coolant further comprises the step of pumping said antifreeze/coolant from a storage tank to said cooling system.

7. The method according to claim 6, wherein said fresh or recycled antifreeze/coolant is pumped through said cooling system with a sufficient force to open said inlet-side thermostat.

8. A method for the change-over of a first liquid in a cooling system of a vehicle with a second liquid where said second liquid displaces said first liquid, said cooling system having an engine with a water pump, an inlet-side thermostat, a radiator, an upper radiator hose section connected to said radiator and an upper engine hose section connected to said engine, said method comprising the steps of:

providing a volume of said second liquid to said upper radiator hose section while said engine is running;

providing liquid collecting means at said upper engine hose section while said engine is running;

displacing a volume of said first liquid with a volume of said second liquid by action of said water pump; and preventing said displacing step if said inlet-side thermostat is closed.

9. A drain-and-fill apparatus for use in exchanging fresh or recycled antifreeze/coolant for used antifreeze/coolant in the cooling system of an automotive engine having an inlet-side thermostat, said apparatus comprising:

a first reservoir for storing said fresh or recycled antifreeze/coolant;

a second reservoir for receiving said used antifreeze/coolant;

an inlet line operatively connectable between said first reservoir and an inlet of said automotive cooling system;

an outlet line operatively connectable between an outlet of said automotive cooling system and said second reservoir;

a pump disposed in said inlet line operable to transfer said fresh or recycled antifreeze/coolant from said first reservoir to said cooling system, whereby said fresh or recycled antifreeze/coolant displaces said used antifreeze/coolant in said automotive cooling system; and a thermostat disposed in said outlet line between said outlet of said cooling system and said second reservoir, said thermostat preventing the flow of said used antifreeze/coolant if said antifreeze/coolant has not reached a predefined temperature.

* * * * *